US006672885B2

(12) United States Patent
Kuroda et al.

(10) Patent No.: US 6,672,885 B2
(45) Date of Patent: Jan. 6, 2004

(54) HIGH-VOLTAGE CONNECTOR

(75) Inventors: Keiji Kuroda, Amagasaki (JP); Daichi Miyamoto, Izumiotsu (JP)

(73) Assignee: J.S.T. Mfg. Co., Ltd., Osaka (JP)

( * ) Notice: Subject to any disclaimer, the term of this patent is extended or adjusted under 35 U.S.C. 154(b) by 0 days.

(21) Appl. No.: 09/991,706

(22) Filed: Nov. 26, 2001

(65) Prior Publication Data

US 2002/0064977 A1 May 30, 2002

(30) Foreign Application Priority Data

Nov. 27, 2000 (JP) ..... 2000-359784

(51) Int. Cl.[7] ..... H01R 12/00
(52) U.S. Cl. ..... 439/79
(58) Field of Search ..... 439/79, 78, 80, 439/81, 82, 83, 947, 934, 732, 682, 541.5, 876

(56) References Cited

U.S. PATENT DOCUMENTS 4,431,253 A * 2/1984 Hochgesang et al. ..... 439/79
4,722,691 A * 2/1988 Gladd et al. ..... 439/79
5,176,528 A * 1/1993 Fry et al. ..... 439/181
6,077,087 A * 6/2000 Endres et al. ..... 439/63
6,109,935 A * 8/2000 Yang ..... 439/80
6,135,790 A * 10/2000 Huang et al. ..... 439/79
6,250,943 B1 * 6/2001 Castle et al. ..... 439/352
6,261,131 B1 * 7/2001 Kuroda et al. ..... 439/732
6,280,206 B1 * 8/2001 Kuroda et al. ..... 439/83
6,309,227 B1 * 10/2001 Chen et al. ..... 439/79
6,332,783 B1 * 12/2001 Ukiya et al. ..... 439/76.1

* cited by examiner

*Primary Examiner*—Ross Gushi
(74) *Attorney, Agent, or Firm*—Antonelli, Terry, Stout & Kraus, LLP

(57) ABSTRACT

A high-voltage connector constructed as a base connector has an insulated housing (2) and two pin contacts (3, 4) held in two compartments (8, 9) separated by a partition (7) that is formed as an integral portion of the housing. Each pin contact consists of a connecting pin and a lead continuing from it, the connecting pins protruding in parallel towards the front opening of the housing (2), and each lead having a lower end to be soldered to a printed circuit board. The compartments (8, 9) are arranged in parallel and up and down on the circuit board. The leads of the pin contacts (23, 27) respectively extend down along the side walls (14, 15) of the housing, and the leads' lower ends (24, 28) are offset fore and aft relative to the housing.

9 Claims, 7 Drawing Sheets

HIGH-VOLTAGE CONNECTOR

FIELD OF THE INVENTION

The present invention relates to a high-voltage connector suited for use with electronic apparatuses driven with higher voltages, and more particularly to a connector used in the inverter boards (viz., circuit boards) serving as power supply circuits for the so-called back-light devices that operate as the light beam source for liquid crystal displays.

PRIOR ART

The printed inverter boards have been made smaller and smaller, so that connectors electrically connecting them to the back-light devices have to be smaller but more resistant to high voltages. The present inventors have therefore filed patent applications for their previous inventions as disclosed in the Japanese Laying-Open Gazettes No. 10-172649 and No. 2000-252005. In these preceding inventions, linear and spatial distances between the contacts in each connector were increased so that it could withstand high voltages.

Basically, the present invention was made to further improve those high-voltage type connectors proposed in said Gazettes so as to decrease their horizontal width. This is because such known connectors are of the "side type" in which two pin contacts held in the insulated housing are for side by side arrangement on a printed inverter circuit board. It has been difficult to satisfy a demand for reduction of space in the direction of their width, although the linear and spatial distances were increased indeed between the pin contacts.

SUMMARY OF THE INVENTION

Thus, an object of the present invention is to provide a high-voltage connector of the 'top type' having two pin contacts that will be arranged up and down on a printed inverter circuit board, while ensuring resistance to high voltages and remarkably diminishing the space occupied by the connector's width.

In order to achieve the object from a first aspect of the invention, a high-voltage connector is a base connector to be mounted on a printed circuit board, the base connector comprising an insulated housing with a front opening, and two pin contacts held in discrete compartments separated by a partition that is formed as an integral portion of the housing. The two pin contacts consist each of a connecting pin and a lead continuing therefrom, wherein the connecting pins protrude in parallel towards the front opening, with the leads having solderable ends capable of being soldered to the circuit board. The compartments each lying horizontally are arranged in parallel and one above another when the connector is mounted on the circuit board, so that the leads of the pin contacts fixed in the compartments respectively extend downwards different distances along the side walls of the housing such that their solderable ends are included in a common plane but are offset fore and aft relative to the housing.

One of the two pin contacts may be an input pin contact, with the other being an output pin contact. Since the input pin contact is prone to be heated due to a high voltage, it is preferable to dispose it in the upper compartment.

In detail, the two solderable ends of those pin contacts extend along the housing bottom wall take their positions offset fore and aft from each other in the housing. It may be possible to afford a sufficient spatial distance between the solderable ends as "lead patterns" in the following manner. The lead of the one pin contact accommodated in the upper compartment will be located intermediate between the front and rear faces of the housing, so as to extend down along one of the side walls of the housing and then to be bent forwards to provide the solderable end along the housing bottom. On the other hand, the other pin contact accommodated in the lower compartment is located near the rear face of the housing, so as to extend down along the other side walls of the housing and then to be bent backwards to provide the other solderable end also along the housing bottom. However, such 'stereographic' configurations may be exchanged between the two leads of pin contacts.

From a second aspect, the present invention also provides a socket connector mating with the high-voltage base connector as summarized above. This socket connector comprises two socket contacts and a socket housing for accommodation thereof, wherein the socket contacts fixed on input and output wire ends are capable of fitting on the respective connecting pins of the contacts held in the base connector. The socket housing, that is bifurcated to have a recess engageable with the partition formed in the base connector housing, comprises two cylindrical chambers each lying horizontally and disposed in parallel and one above another to respectively hold the socket contacts. Further, an ear protrudes backwards from the rear end of one side wall of the socket housing.

Thus, the two wire ends connected to the socket connector take their positions up and down and in parallel with each other, and the socket connector is shaped narrow corresponding to the high-voltage base connector. In use, the ear protruding from the socket housing may serve as a pick-up knob that will assist an operator to easily insert the socket connector into or remove it from the base connector at a right angle relative thereto. The ear will also protect the wire ends from being injured due to their bending or flexing during a wiring operation. Preferably, the lower face of the ear may be spaced a distance from the housing bottom, lest the ear should collide with the printed circuit board having the base connector fixed thereon when the socket connector is handled to engage therewith or disengage therefrom. Any finger recess formed in the outer side face of such an ear will further assist the operator to correctly grip the socket housing. Further, a lug facing the ear may be formed to protrude sideways from the other side wall of housing so as to cooperate with the ear to render more convenient the picking motion.

THE PREFERRED EMBODIMENTS

Figure 1:
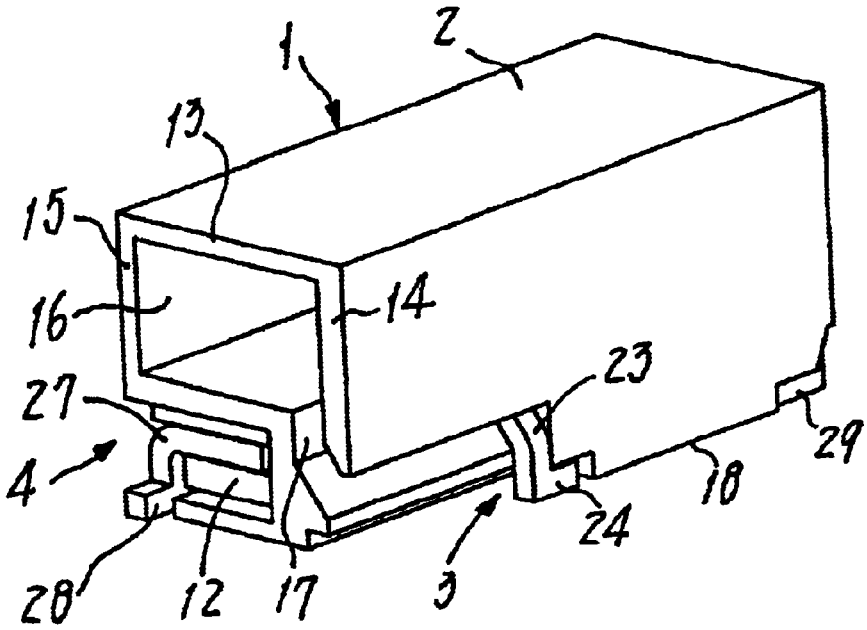
FIG. 1 is a perspective view of a high-voltage base connector provided in an embodiment of the invention and seen forwards from its rear end.

Now, some preferred embodiments will be described referring to the drawings. FIGS. 1 to 7 show a high-voltage type base connector 1 provided herein and comprising a base housing 2 that is a cylindrical body generally square in cross section. An input pin contact 3 and an output pin contact 4 are separately held in the housing to form the base connector.

Figure 2:
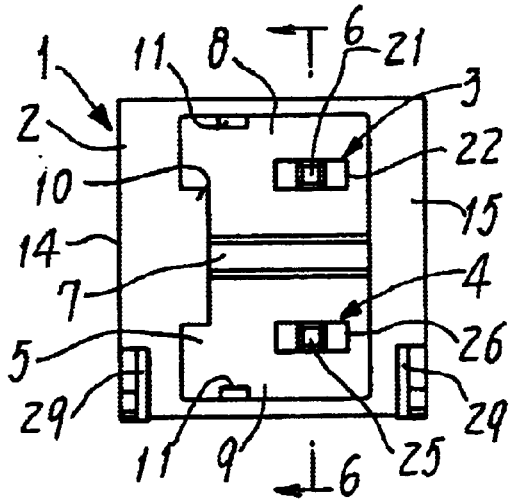
FIG. 2 is a front elevation of the connector.
Figure 3:
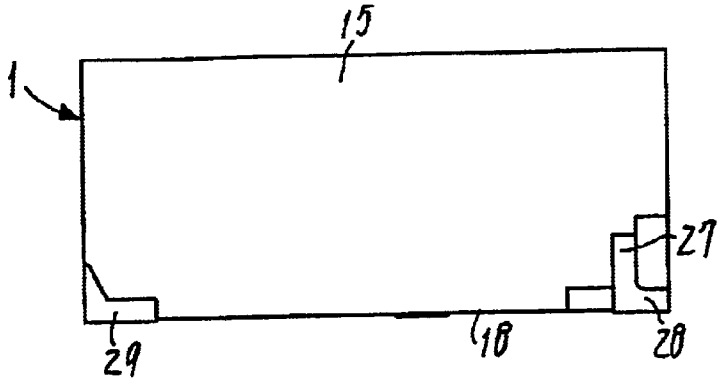
FIG. 3 is a side elevation of the connector.
Figure 4:
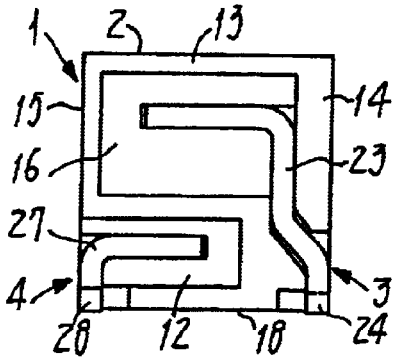
FIG. 4 is a rear elevation of the connector.
Figure 5:
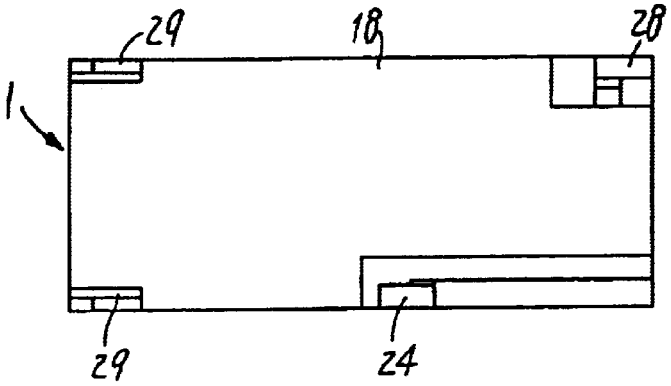
FIG. 5 is a bottom plan view of the connector.
Figure 6:
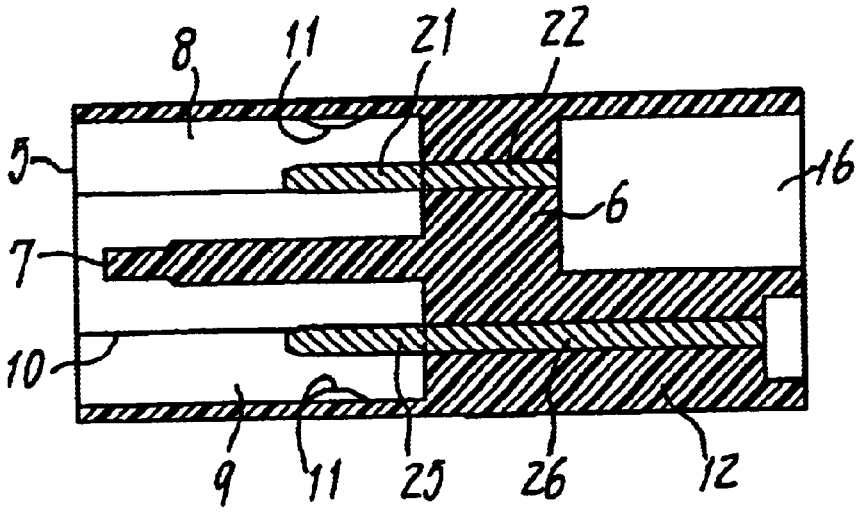
FIG. 6 is a cross section taken along the line 6—6 in FIG. 2.

The base housing 2 is molded using a heat-resistant resin of a suitable kind such as a PA6T (viz., a polyamide), an LCP (viz., a liquid crystal polymer), PPS or the like. As seen in FIGS. 2 and 6, two compartments 8 and 9 defined in the housing do face a front opening 5 thereof, and they are isolated from each other by a partition 7. This horizontal partition 7 continuing forwards from the middle height of a vertical and thick middle wall 6 extends to the front opening 5. The two compartments 8 and 9 thus lying horizontally are arranged in parallel and up and down to thereby reduce or minimize horizontal width of the base housing 2. A guide ridge 10 is formed along one of lateral sides of the horizontal partition 7, so that a socket connector 30 described below and taking a wrong position is inhibited from insertion into the base housing. Locking lugs 11 protrude from the inner wall surfaces of compartments 8 and 9 so as to engage with corresponding cutouts of the socket connector 30. Continuing from a lower half of the vertical middle wall 6 is a thickened bottom 12 extending to the rear end of the housing 2. A cavity 16 is thus defined between thickened bottom 12, an upper wall 13 of the housing and lateral side walls 14 and 15 thereof. As shown in FIGS. 1 and 4, a cutout passage 17 communicating with this cavity 16 is formed between bottom 12 and one of the side walls 14, for guiding 3 into the housing the input pin contact to take a fixed position therein.

Figure 7:
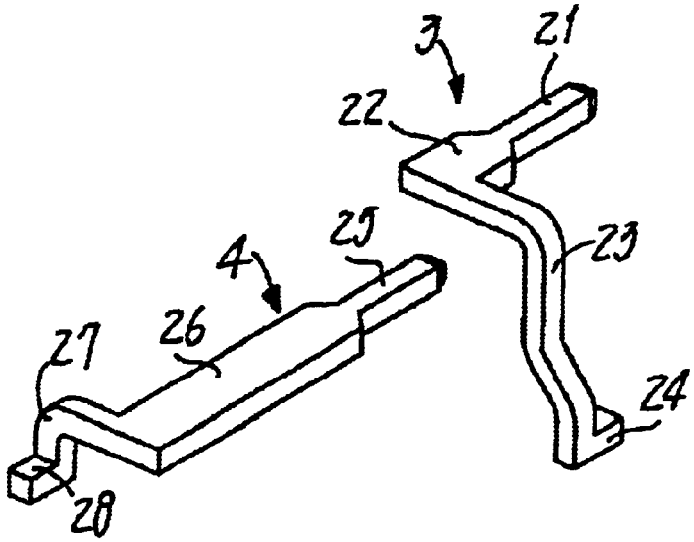
FIG. 7 is a perspective view of two pin contacts of the connector.

The pin contacts 3 and 4 are made by punching a conductive metal such as a copper alloy plate to produce raw pieces and then bending same into designed shapes shown in FIG. 7. The input pin contact 3 has, as its integral portions, a connecting pin 21 and a wide and shorter body 22 continuing back therefrom. This body 22 is supported in position, and a lead continues sideways from the rear end thereof and then is bent down to provide a longer leg 23. The lower end portion of this leg 23 is bent forwards to form there a solderable end 24. Similarly, the output pin contact 4 has as its integral portions a connecting pin 25 and a wide and longer body 26 continuing from the rear end of this pin. This body is supported in position, and a lead continues sideways from the rear end of the body 26 and then is bent down to provide a shorter leg 27. The lower end portion of this leg 27 is bent backwards to form there a solderable end 28.

The input pin contact 3 is more likely than the output one 4 to become heated due to a high voltage applied thereto, so that it is placed in the upper compartment 8 remote from the circuit board. Therefore, the connecting pin 21 of the input pin contact 3 penetrates an upper region of the middle wall 6 and extends towards the front opening 5 and along the horizontal axis of housing 2 so that this wall supports the input contact in the upper compartment 8. The leg 23 protruding backwards from the middle wall 6 does extend downwards in the middle region of the housing 2 and along its side wall 14, so as to pass through the cutout passage 17 and reach the bottom 18 of the housing. The solderable end 24 of this contact 3 extends forwards along this bottom 18. Likewise, the connecting pin 25 of the output pin contact 4 penetrates a lower region of the middle wall 6 and extends also towards the front opening 5 and along the horizontal axis of housing 2. Thus, the output pin contact 4 penetrates both the wall 6 and the thickened bottom 12, so that the latter two will support the former in the lower compartment 9. The leg 27 protruding backwards from the thickened bottom 12 does extend downwards in the rear end region of the housing 2, to thereby reach the bottom 18 of the housing. The solderable end 28 of the output contact 4 extends backwards along this bottom 18.

As the input and output pin contacts are set in the housing 2, the solderable end 24 of the former contact 3 and that 28 of the latter 4 will take their positions located right and left and shifted fore and aft. A sufficient spatial distance is thus afforded between those solderable ends 24 and 28 to enhance resistance to high voltages, while diminishing size of the connector in transverse direction (see FIG. 5). The reference numeral 29 denotes reinforcement metals that are fitted in fore and lower corners of the side walls 14 and 15 of the housing 2.

Figure 8:
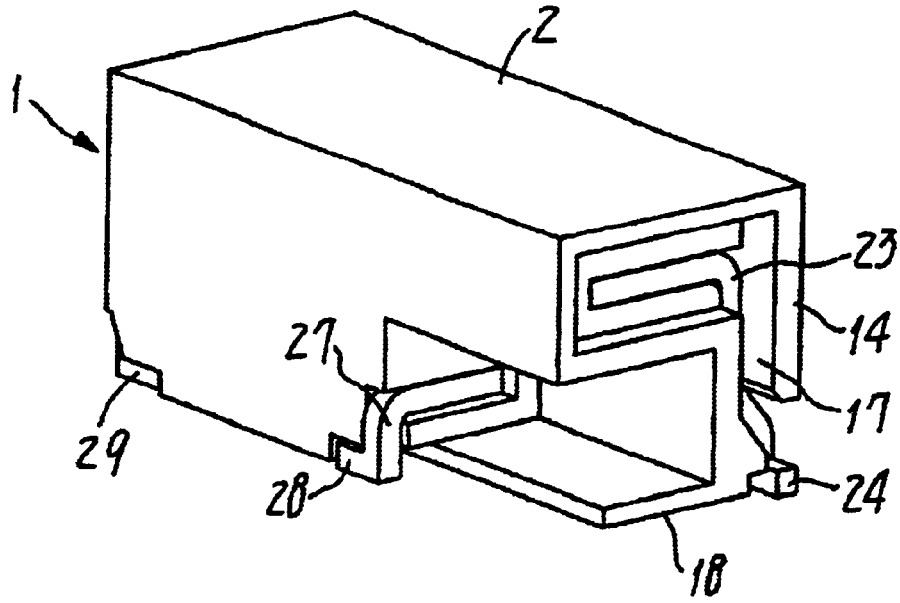
FIG. 8 is a perspective view of the high-voltage base connector provided in another embodiment and seen forwards from its rear end.
Figure 9:
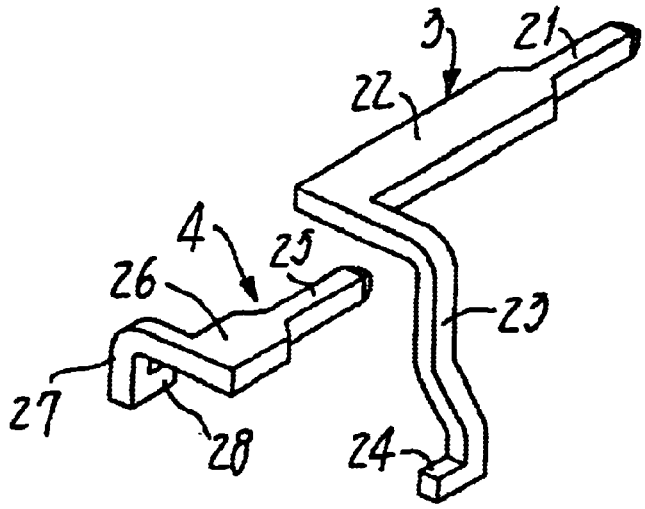
FIG. 9 is a perspective view of the two pin contacts in another example of the connector.
Figure 10:
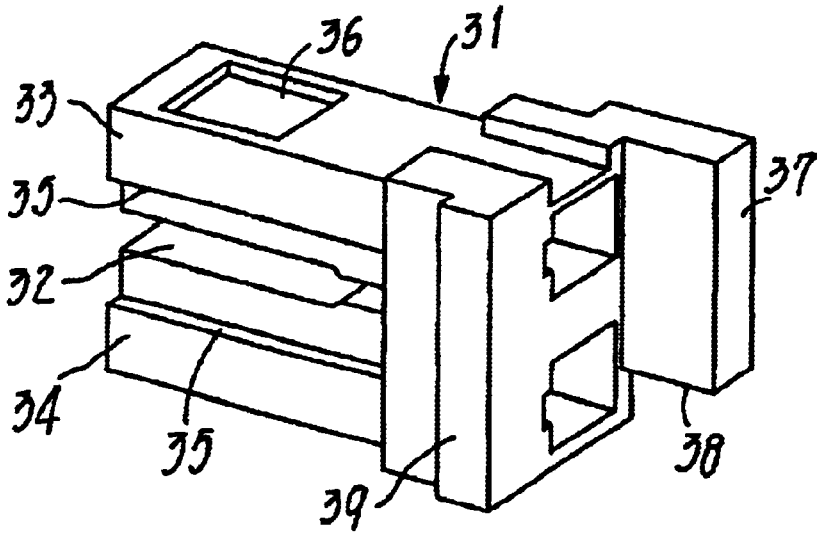
FIG. 10 is a perspective view of a socket housing constituting a high-voltage socket connector provided herein.
Figure 11:
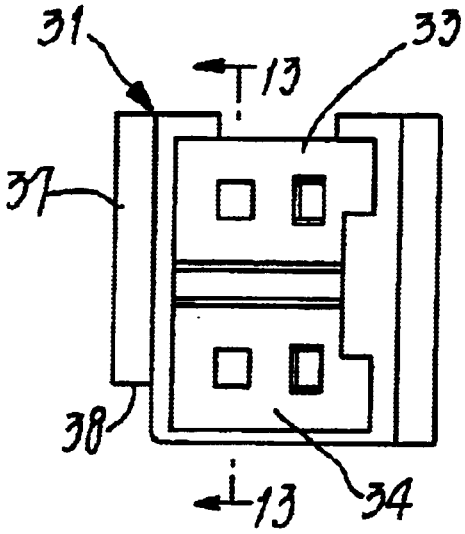
FIG. 11 is a front elevation of the socket housing.
Figure 12:
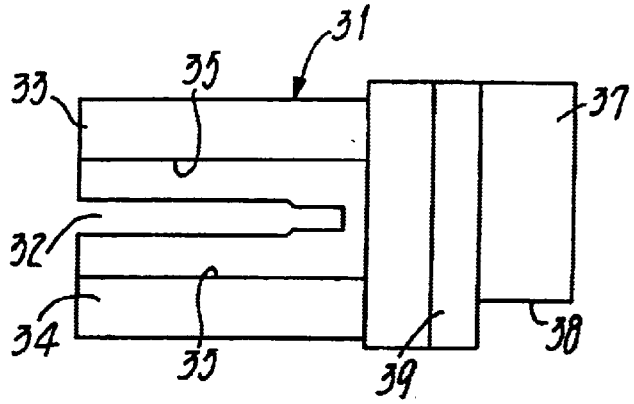
FIG. 12 is a side elevation of the socket housing.
Figure 13:
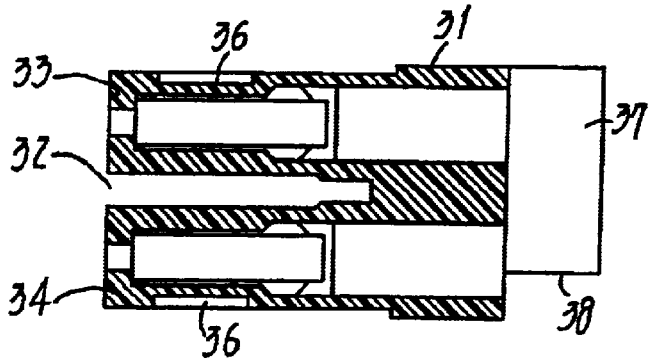
FIG. 13 is a cross section taken along the line 13—13 in FIG. 11.

FIGS. 8 and 9 show a modification, wherein the two pin contacts 3 and 4 are of shapes reversed as compared with those in the example described above. In this case, the latter contact 4 held in the lower compartment 9 serves as an input terminal, with the former 3 serving as an output terminal in the upper compartment 8. The body 22 and leg 23 of the pin contact 3 are respectively longer than those 26 and 27 of the other contact 4. The solderable end 24 of the pin contact 3 is bent backwards to extend along the housing bottom 18, and thus disposed at rear end thereof. The other solderable end 28 of the other contact 4 is bent forwards to also extend along the housing bottom 18, but disposed at fore end thereof. Also in this case, a sufficient spatial distance is afforded between the solderable ends 24 and 28 to enhance resistance to high voltages.

A socket connector 30 (see FIG. 14) will now be described, which is to be coupled with the high-voltage base connector 1 discussed above. As shown in FIGS. 10 to 13, the socket connector 30 comprises a somewhat peculiar socket housing 31. Similarly to the base housing 2, the socket housing is made of a thermoplastic resin such as a PA66 (viz., polyamide) or PBT. This housing 31 is bifurcated to have a recess 32 to fit on the partition 7 of the base housing 2 which encloses and constitutes the base connector. A pair of cylindrical chambers 33 and 34 are formed in parallel and up and down, lying horizontally to fit in the respective compartments 8 and 9 in the base housing. The guide ridge 10 of base housing will fit in stepped recesses 35 that are formed in and along one side walls of the cylindrical chambers 33 and 34. Cutouts 36 in the top wall of the upper chamber 33 and the bottom of the lower chamber 34 will respectively engage with the locking lugs 11 of the base housing 2. An ear 37 jutting backwards from the rear end of one side wall of the socket housing 31 will be convenient for an operator or user. He or she can grip the socket connector 30 at this ear 37, with his or her fingers, when coupling it with or removing it from the base connector 1. Preferably, and for the purpose mentioned above, a gap is provided between the bottom of such an ear and the bottom of the housing 31. Further, two wire ends (referred to later) secured to the socket connector 30 will be protected from damage when handled around the connector during any wiring operation. A lug 39 protruding from the other side wall of the housing 31 also at its rear end will cooperate with the ear 37 to facilitate the operator's gripping motion. Any proper recesses or dimples (not shown) that may be formed in the outer sides of those ear 37 and lug 39 will further assist him or her to pick up the socket connector in a correct way.

Figure 14:
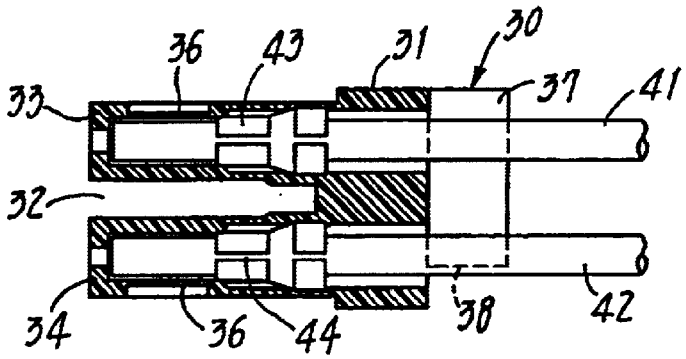
FIG. 14 is a vertical cross section of the socket connector whose housing has accommodated therein socket contacts crimped on wire ends.

FIG. 14 shows that the socket connector 30 is constructed by fixing in the socket housing 31 a couple of socket contacts 43 and 44, that are previously secured on two wire ends 41 and 42, respectively. Both the contacts are inserted forwards through a rear opening of said housing 31, so that one of the contacts 43 for the input wire 41 is held in the upper cylindrical chamber 33. The other contact 44 for the output wire 42 is however held in the lower one 34.

Figure 15:
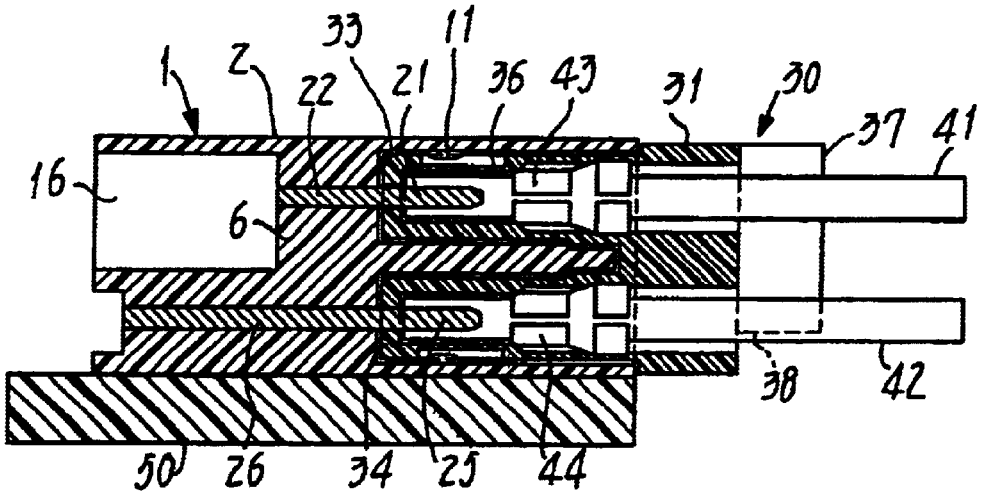
FIG. 15 is a vertical cross section of the high-voltage base connector and socket connector shown in use.
Figure 16:
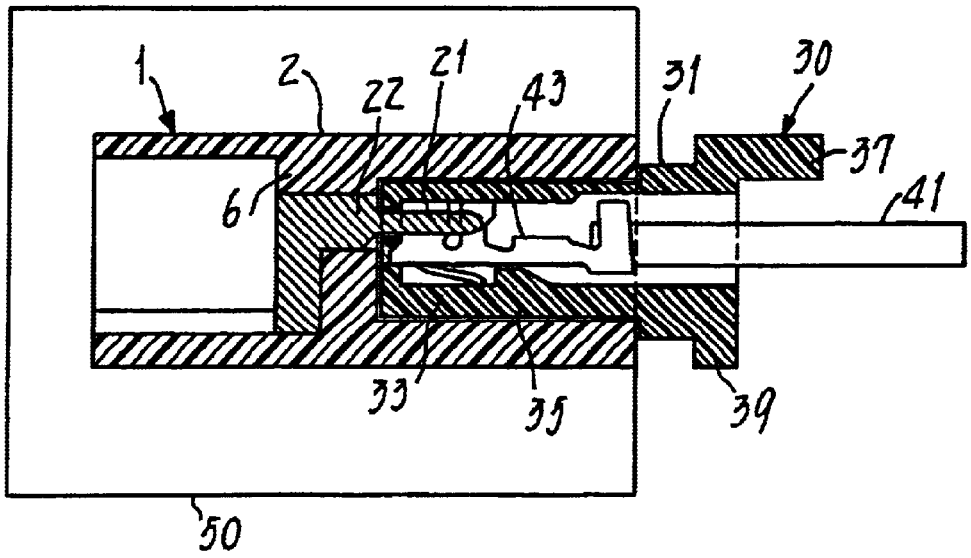
FIG. 16 is a horizontal cross section of the base and socket connectors, also shown in use.

In use, the base connector 1 of FIGS. 1 to 7 will be combined with the socket connector 30 of FIG. 14 in a manner as seen in FIGS. 15 and 16. A printed circuit board 50 comprising a power supply circuit for the back-light inverter of a liquid crystal display may thus be equipped with the base connector 1 surface-mounted thereon. Portions of a lead pattern (not shown) are soldered to the solderable ends 24 and 28 of the input and output pin contacts 3 and 4, respectively, so as to lead to a power souce circuit (also not shown). Both the reinforcement metals 29 are also soldered to the circuit board 50 so as to firmly secure the base connector thereon.

The base connector 1 in this state is ready for reception of the socket connector 30. The ear 37 and lug 39 of the latter connector will be gripped with an operator's fingers in order to correctly position its chambers 33 and 34 relative to the corresponding compartments 8 and 9 of the base connector. Subsequently, he or she will push the socket connector towards base connector 1, until the recess 32 fits on the partition 7 and the guide ridge 35 engages with the stepped cutouts 35 to thereby enable a further smooth advance of socket connector deeper into base connector. The connecting pins 21 and 25 of the pin contacts 3 and 4 will thus enter the cylindrical chambers 33 and 34. As a result, those pins 21 and 25 snap in the socket contacts 43 and 44 so as to establish an electric connection between them (21 and 43, 22 and 44). This final state may be confirmed by the operator by a clicking shock or the like sensed by him or her. Two wires 41 and 42 from the socket contacts 43 and 44 lead to terminals (not shown) which the back-light for a liquid crystal panel does have.

The power supply circuit comprising the base connector 1 for the back-light inverter as detailed above will sufficiently be resistant to high voltages, owing to an increased spatial distance ensured between the solderable ends 24 and 28 of the two pin contacts 3 and 4.

In summary, the present high-voltage base connector has two pin contacts disposed in parallel one above another when mounted on a circuit board, such that their leads' solderable ends extending along the housing bottom are spaced fore and aft from each other. Spatial distance between those ends is long enough to enhance resistance to high voltages, while such an up-and-down arrangement of those contacts rendering slim and less massive the base housing in a direction of its width.

The present socket connector having two parallel wires up and down is of a decreased width corresponding to the base connector. The socket connector's ear juts back from the rear end of its one side wall to be gripped for easier insertion into and removal from the base connector. The ear will be seized always at its correct position to avoid a reversed insertion of the socket connector, and will serve as a means for protecting the wire ends from damage when they are handled around the connector.

What is claim is:

1. A high-voltage connector constructed as a base connector to be mounted on a printed circuit board, the base connector comprising: an insulated housing with a front opening, and two pin contacts held in upper and lower compartments separated by a partition that is formed as an integral portion of the housing, the two pin contacts consisting each of a connecting pin and a lead continuing therefrom, with the connecting pins protruding in parallel towards the front opening, and with the leads each having a solderable end capable of being soldered to the circuit board, wherein the compartments each lying horizontally are arranged in parallel and one above another when the connector is mounted on the circuit board, so that the lead of the one pin contact accommodated in the upper compartment is located intermediate between front and rear faces of the housing, so as to extend down along one of the side walls of the housing and then to be bent to provide the solderable end along the housing bottom, the other pin contact accommodated in the lower compartment is located near the rear face of the housing, so as to extend down along the other side walls of the housing and then to be bent to provide the other solderable end also along the housing bottom, whereby a sufficient spatial distance is provided between the solderable ends that extend along respective bottoms of the side walls and are offset fore and aft relative to the housing.

2. A high-connector as defined in claim 1, wherein the two contacts are an input pin contact and an output pin contact, and the input pin contact is disposed in the upper compartment.

3. A high-voltage connector constructed as a base connector to be mounted on a printed circuit board, the base connector comprising: an insulated housing with a front opening, and two pin contacts held in upper and lower compartments separated by a partition that is formed as an integral portion of the housing, the two pin contacts consisting each of a connecting pin and a lead continuing therefrom, with the connecting pins protruding in parallel towards the front opening, and with the leads each having a solderable end capable of being soldered to the circuit board, wherein the compartments each lying horizontally are arranged in parallel and one above another when the connector is mounted on the circuit board, so that the lead of the one pin contact accommodated in the lower compartment is located intermediate between front and rear faces of the housing, so as to extend down along one of the side walls of the housing and then to be bent to provide the solderable end along the housing bottom, the other pin contact accommodated in the upper compartment is located near the rear face of the housing, so as to extend down along the other side walls of the housing and then to be bent to provide the other solderable end also along the housing bottom, whereby a sufficient spatial distance is provided between the solderable ends that extend along respective bottoms of the side walls and are offset fore and aft relative to the housing.

4. A high-connector as defined in claim 3, wherein the two contacts are an input pin contact and an output pin contact, and the input pin contact is disposed in the upper compartment.

5. A high-voltage connector as defined in claim 1 or 3, wherein one of the solderable ends of the pin contacts is located intermediate between the front and rear faces of the housing so as to extend forwards along the housing bottom, and the other of the solderable ends of the pin contacts is located near the rear face of the housing so as to extend backwards along the housing bottom.

6. The combination of a socket connector mated with the high-voltage connector according to claim 1 or 3, wherein the socket housing is bifurcated to have a recess engageable with the partition formed in the base connector housing, and comprises two cylindrical chambers each lying horizontally and disposed in parallel and one above another to respectively hold the socket contacts, and further comprising an ear protruding backwards from a rear end of one of side walls defining the socket housing.

7. A socket connector as defined in claim 6, wherein the ear has a bottom spaced from a bottom of the socket housing.

8. A socket connector as defined in claim 6, further comprising a lug jutting sideways from a rear end of the other side wall of the socket housing, so as to be cooperative with the ear.

9. A socket connector as defined in claim 7, further comprising a lug jutting sideways from a rear end of the other side wall of the socket housing, so as to be cooperative with the ear.

* * * * *